US005287150A

United States Patent [19]

Kinoshita et al.

[11] Patent Number: 5,287,150

[45] Date of Patent: Feb. 15, 1994

[54] DEVELOPING DEVICE INCLUDING ROTATABLE RESILIENT ROLLER FOR SUPPLYING DEVELOPER TO AND REMOVING DEVELOPER FROM A DEVELOPER BEARING MEMBER

[75] Inventors: Masahide Kinoshita, Yokohama; Yoshiaki Kobayashi, Tokyo, both of Japan

[73] Assignee: Canon Kabushiki Kaisha, Tokyo, Japan

[21] Appl. No.: 937,725

[22] Filed: Sep. 1, 1992

[30] Foreign Application Priority Data

| | | | |
|---|---|---|---|
| Sep. 6, 1991 | [JP] | Japan | 3-254279 |
| Jun. 25, 1992 | [JP] | Japan | 4-190158 |
| Jul. 28, 1992 | [JP] | Japan | 4-201007 |

[51] Int. Cl.[5] ..... G03G 15/06

[52] U.S. Cl. ..... 355/259; 118/653; 118/656; 355/253

[58] Field of Search ..... 355/245, 253, 259; 118/653, 656

[56] References Cited

U.S. PATENT DOCUMENTS

| | | | |
|---|---|---|---|
| 4,827,305 | 5/1989 | Enoguchi et al. | 355/259 |
| 5,030,996 | 7/1991 | Tajima et al. | 355/246 |
| 5,075,728 | 12/1991 | Kobayashi et al. | 355/260 |
| 5,086,728 | 2/1992 | Kinoshita | 118/653 |
| 5,170,213 | 12/1992 | Yamaguchi et al. | 118/653 X |
| 5,177,323 | 1/1993 | Kohyama | 118/653 |

*Primary Examiner*—A. T. Grimley
*Assistant Examiner*—William J. Royer
*Attorney, Agent, or Firm*—Fitzpatrick, Cella, Harper & Scinto

[57] ABSTRACT

A rotatable developing roller for carrying out a developer from a vessel containing one-component developer to be conveyed to a developing portion is provided with a developing roller a resilient roller in contact with and rotatable within the vessel. This resilient roller is an independently-porous foam roller having an Asker C hardness of 8° to 15°, and is placed into contact with the developing roller so that the variation in a radial direction is 0.5 mm to 1.5 mm. In another aspect, under a surface layer of a cellular material, there is provided an intermediate layer of a cellular material having a compression resiliency lower than that of the surface layer.

5 Claims, 2 Drawing Sheets

DEVELOPING DEVICE INCLUDING ROTATABLE RESILIENT ROLLER FOR SUPPLYING DEVELOPER TO AND REMOVING DEVELOPER FROM A DEVELOPER BEARING MEMBER

BACKGROUND OF THE INVENTION

1. Field of the Invention

The present invention relates to a developing device for use in an image forming apparatus such as an electrophotographic apparatus, and more particularly to a developing device for developing an electrostatic latent image with a dry-type one-component developer.

2. Related Background Art

In dry-type one-component developing devices, it is preferable to provide a developer removal/supply member to remove a developer from the surface of a developer bearing member passing through a developing portion at a position upstream of a regulating member for regulating the thickness of a developer layer born by the developer bearings member to the developing portion with respect to a rotational direction of the developer bearing member, as well as supplying the developer onto the surface of the developer bearing member proceeding toward the regulating member.

A well known developer removal/supply member is a brush roller or foamed rubber roller which rotates in contact with a developer bearing member within a developer containing vessel, as described in U.S. Pat. Nos. 5,075,728 and 5,086,728. The foamed rubber roller may be a continuously-porous or independently-porous foamed rubber roller.

However, a resilient roller of the brush structure as above described is constructed by flocking fibers such as nylon or rayon on a metallic core, wherein there may be clogging between the regulating member and the developer bearing member due to fibers falling out from repetitive use of the developing device over a long term. As a result, there were some cases where white streaks arose on defective portions, and the resilient roller failed to make contact with the developer bearing member because of deterioration of the fibers, whereby the reproduction of a full black image was sometimes insufficient due to ineffective supply and peeling off of developer. Thus, the resilient roller was constituted of a continuously-porous cellular material (with cells communicating with each other, such as polyurethane having a relatively low hardness and placed into contact with the developer bearing member at low pressure, without applying any excessive pressure on the developer, whereby it was made possible to supply the developer onto the developer bearing material and peel off the developer left unconsumed by the development, owing to adequate irregularities on the surface of cellular material.

However, in such a developing device, particularly when a fine grain developer is used under high humidity environments, the developer may gradually enter into the depth of the resilient roller in a number of repetitive developing operations, because the resilient roller is formed of a continuously-porous cellular material having a relatively low density. If such interstitial developer spread over the entire area of the resilient roller, the resilient roller became rigid, and the contact pressure against the developer bearing member became excessive, increasing the driving torque for the developer bearing member and the resilient roller, or causing some unevenness in the developer on the developer bearing member which could be applied and peeled off by the resilient roller, so that the thickness of a developer layer on the developer bearing member might undesirably vary.

In order to prevent the inconvenience due to clogging of developer within the resilient roller, the following constitution can be considered.

(1) A non-cellular skin layer for preventing the penetration of developer is provided on the surface of the resilient roller (U.S. Pat. No. 5,086,728).

(2) The resilient roller is constituted of an independently-porous cellular material (cells not communicating with each other).

(3) Cells (bubbles) of a continuously-porous cellular material are made as fine as possible to obtain a higher density roller.

However, when such a constitution is used for the resilient roller, the following inconveniences may arise. First, with the constitution (1), if the skin layer is placed into contact with the surface of the developer bearing member and rubbed, the action of rubbing the developer on the surface of the skin layer against the developer bearing member may be too strong, and when a number of developing operations are made, the developer may be fused onto the developer bearing member, or the developer material may be changed (developer deterioration), so that the fog might undesirably increase. Also, if the surface of the skin layer is made adequately coarse, the hardness becomes locally higher as compared with the surface of the cellular material (with the local pressure against the developer bearing member being higher), whereby the same problem could not be prevented.

Next, the constituion (2) was described in U.S. Pat. Nos. 5,075,728 and 5,086,728, but no disclosure of the problems and their measures with the independently-porous cellular material roller was made.

With the constitution (3), if a continuously-porous cellular material having cells as fine as possible (a cell number of 100 cells/inch) is used, rather than the continuously-porous cellular material having the typical number of cells, for example, a cellular material such as polyurethane foam having the cell number of 30 to 50 cells/inch, the entry of toner into the inside of the resilient roller can be prevented to some extent, but the overall hardness of the resilient roller becomes too high. Hence, if such an arrangement is taken that the resilient roller is stably and securely placed into contact with the developer bearing member, the contact pressure against the developer bearing member as well as the developer becomes excessive, increasing the driving torque for the developer bearing member and the resilient roller or raising the fog associated with the developer material change (toner deterioration) due to durability, whereby there occurs some inconvenience.

SUMMARY OF THE INVENTION

An object of the present invention is to provide a developing device which can resolve the above-mentioned inconveniences or drawbacks.

Another object of the present invention is to provide a developing device having a resilient roller allowing for the excellent supply and peeling off of a developer on a developer carrying member, without applying any excessive pressure against the developer bearing member and the developer on the developer bearing member, over a long term service.

A further object of the present invention is to provide a developing device which can prevent the deterioration of a developer.

Other objects and features of the present invention will be apparent from the following description.

DESCRIPTION OF THE PREFERRED EMBODIMENTS

Figure 1:
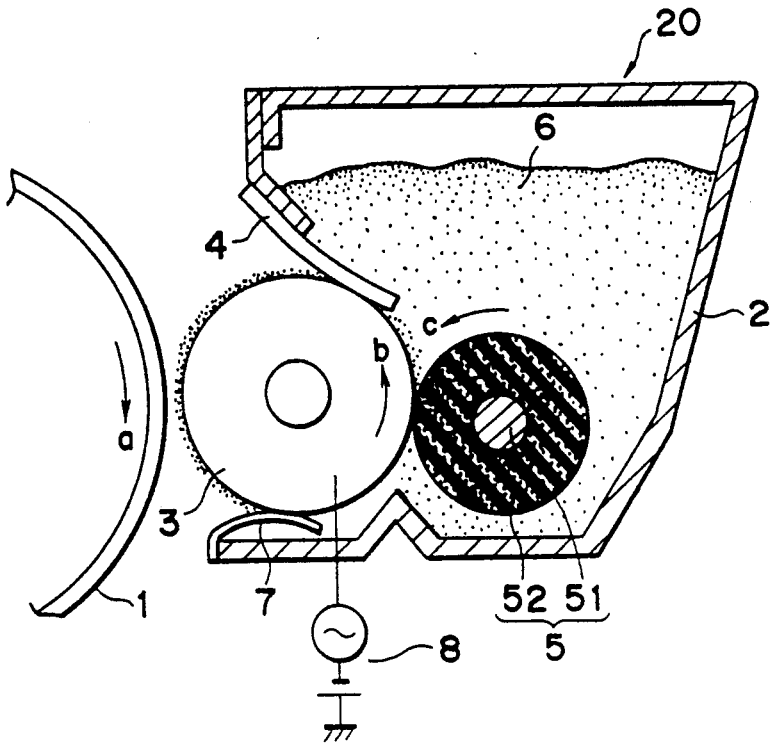
FIG. 1 is an explanation view of one embodiment of the present invention.

In FIG. 1, 2 is a developing vessel containing a non-magnetic toner 6 as a one-component developer. A developing device 20 comprises a developing sleeve (developing roller) 3 installed opposed to an electrophotographic photosensitive drum 1 rotating in a direction of arrow a.

A resilient blade 4 for regulating the thickness of a toner layer to be conveyed to a developing portion is provided inclined downward toward a direction upstream in a rotational direction (arrow b) of the developing sleeve 3, and placed into contact with an upper peripheral surface of the developing sleeve 3 along a counter direction to the rotational direction of the sleeve. Also, a resilient roller 5 is placed in contact with the sleeve 3 within the vessel 2 on the upstream side of the blade 4 in the rotational direction of the developing sleeve 3, and supported for free rotation.

Thus, the resilient roller 5 is rotated in a direction of arrow c to bear the toner 6 within the vessel 2 and supply it near the developing sleeve 3, and the toner 6 on the resilient roller 5 is rubbed against the developing sleeve 3 at a contact portion (nip portion) between the developing sleeve 3 and the resilient roller 5, whereby the toner 6 can adhere onto the developing sleeve 3. Thereafter, with the rotation of the developing sleeve 3, the toner 6 adhering onto the developing sleeve 3 is carried a contact region between the resilient blade 4 and the developing sleeve 3, and rubbed against the surface of the developing sleeve 3 and the resilient blade 4 in passing therethrough to be subjected to a sufficient frictional electrification.

The toner thus charged forms a thin layer on the developing sleeve 3 and then is conveyed to the developing portion. By applying an oscillating voltage in which AC voltage is superimposed on DC voltage as a developing bias voltage from a power source 8 to the developing sleeve 3, the toner 6 on the developing sleeve 3 is transferred correspondingly to a static latent image on the photosensitive drum 1 in the developing portion, and the static latent image is developed as a toner image for visualization.

By the way, the toner 6 remaining on the developing sleeve 3 without being consumed for the development in the developing portion is recovered within the developing vessel 2, with the rotation of the developing sleeve 3. A toner recovering portion of the developing vessel 2 is provided with a seal member 7. The seal member 7 allows for the transit of the toner 6 remaining on the developing sleeve 3 into the developing vessel 2, and presents the toner 6 within the developing vessel 2 from leaking out of the underside of the vessel 2. Thus, the toner 6 recovered within the developing vessel 2 is peeled off from the developing sleeve 3 by the resilient roller 5 at a contact region between them. At the same time, new toner 6 is supplied onto the developing sleeve 3, with the rotation of the resilient roller 5, and this new toner 6 is also conveyed into a contact region between the developing sleeve 3 and the resilient blade 4, with the rotation of the developing sleeve 3.

On the other hand, most of the toner 6 pelled off is conveyed and mingled into the toner 6 within the developing vessel 2 with the rotation of the resilient roller 5, whereby electric charges on the peeled toner 6 are distributed.

By the way, an adequately irregular roughness is formed on the surface of the developing sleeve 3, thereby enhancing the probability of rubbing the toner against the surface of developing sleeve 3, as well as improving the conveyance of the toner 6. That is, such irregular roughness on the surface of developing sleeve 3 can be formed by subjecting the surface of developing sleeve 3 to a sandblasting treatment with alundum abrasive grains of irregular shapes or glass beads of definite circular shape, so that the surface roughness Rz is 1 μm to 10 μm. Also, the irregular roughness may be formed on the surface of developing sleeve 3, by using grains of metallic oxide or conductive grains of graphite or carbon, for example, and binding them with a binding resin such as phenol resin or fluoresin so as to coat the surface of the sleeve substrate.

In this example, the developing sleeve 3 may be an aluminum sleeve having a diameter of 16 mm, for example, which is subjected to a sandblasting treatment with glass beads (#600) of definite shape on the surface thereof to have a surface roughness of about 3 μm.

The resilient blade 4 is pressed against the developing sleeve 3, and the toner entering therebetween is applied onto the developing sleeve 3 so that a thin layer is formed. The resilient blade 4 is formed of a rubber material (having a hardness according to JISA of 40° to 90°) such as silicone rubber or urethane rubber, wherein a part of the resilient blade 4 against the developing sleeve 3 presses the developing sleeve 3 in facial contact therewith.

In the present invention, the contact pressure of the resilient blade 4 against the developing sleeve 3 is preferably a line pressure of 5 g/cm to 200 g/cm in a direction of a generating line of the developing sleeve 3, wherein in this embodiment a resilient blade 4 made of urethane having a hardness of 65° and a thickness of 1.2 mm is used and pressed against the developing sleeve 3 at a line pressure of 50 g/cm.

The measurement method of the line pressure is to insert three superposed thin plates having a known frictional coefficient into a contact portion between the resilient blade 4 and the sleeve 3, pull out a central thin plate with a spring balance and calculate the line pressure from a drawing force and a frictional coefficient as measured at this time.

The non-magnetic toner 6 is used as a non-magnetic one-component developer, and made up by distributing a pigment of e.g. carbon into various plastic resins such as styrene resin, acrylic resin or polyethylene resin. In this embodiment, the toner 6 was a toner powder having an average grain diameter of 8 μm and consisting of a copolymer of styrene/acrylic resin and styrenebutadiene resin and a pigment, with the addition of 1.0% colloidal silica.

Next, the resilient roller 5 in this embodiment will be described in detail.

The resilient roller 5 peels off the toner remaining on the developing sleeve 3 and supplies new toner 6, as previously described. As shown in FIG. 1, this resilient roller 5 is one in which a metallic core 51 is provided as the support shaft, around which an independently-porous cellular material 52 such as silicone rubber, EPDM rubber or CR rubber in which wall faces of bubble portions do not communicate with those of adjacent bubble portions is bonded like a roll.

In this embodiment, the resilient roller 5 is constituted of a metallic core 51 having an external diameter of 5 mm which is covered with a silicone rubber foam 52 having a thickness of 5 mm like a roller, and has an external diameter of 15 mm. The developing sleeve 3 is movable on a line extending from a rotational center A of the resilient roller 5 to a rotational center B of the developing sleeve 3, wherein the axial distance x between the developing sleeve 3 and the resilient roller 5 can be changed.

By the way, by forming the resilient roller 5 of an independently-porous cellular material, the toner can be efficiently applied onto the developing sleeve or peeled therefrom, owing to adequate irregularities on the roller surface, and it is possible to prevent the resilient roller 5 from being hardened due to clogging of the toner within the roller.

However, if the resilient roller is constructed of an independently-porous cellular material having too high a rubber hardness, the contact pressure against the developing sleeve 3 with the toner becomes excessive when the resilient roller is securely placed into contact with the developing sleeve 3, thereby increasing the torque as occurs when a conventional roller formed of continuously-porous cellular material is hardened, and incurring a fog growth phenomenon due to the toner fusion to the developing sleeve and the toner degradation.

On the other hand, if the resilient roller is constructed of an independently-porous cellular material having too low a rubber hardness, low molecular weight components of rubber are contained in large quantity within the cellular material and may exude and adhere to the developing sleeve in a number of repetitive developing operations and toner supplies, so that the resilience is remarkably degraded. Owing to adherence (contamination) of low molecular weight components of rubber on to the developing sleeve, a toner newly supplied on to the developing sleeve is not properly and sufficiently charged due to friction, yielding some fog and reducing the resilience, so that the contact of the resilient roller with the developing sleeve may fail, thereby causing a reproduction failure of a full black image due to inefficient supply and peeling off of the toner.

Moreover, it has been found that the variation δ of resilient roller in a radial direction due to the pressure against the developing sleeve, as well as the hardness of the resilient roller, have some influence on the quality of a developed image. That is, when the variation δ of the resilient roller in the radial direction is too large, the contact pressure of the resilient roller against the developing sleeve with the toner becomes excessive because the independently-porous cellular material has a higher hardness than the continuously-porous cellular material, even if it is within a proper range of the variation δ of a resilient roller consisting of a continuously-porous cellular material. As a result, the action of rubbing the toner against the developing sleeve is too strong, thereby raising the fog due to the toner fusion to the developing sleeve and the material change (deterioration) of the toner, and remarkably increasing the driving torque for the developing sleeve and the resilient roller.

When the variation δ is too small, the contact of the resilient roller against the developing sleeve may be uneven in a longitudinal direction, so that the toner is unevenly applied to or peeled off of the developing sleeve by the resilient roller, thereby undesirably causing image blurs in the longitudinal direction.

Figure 2:
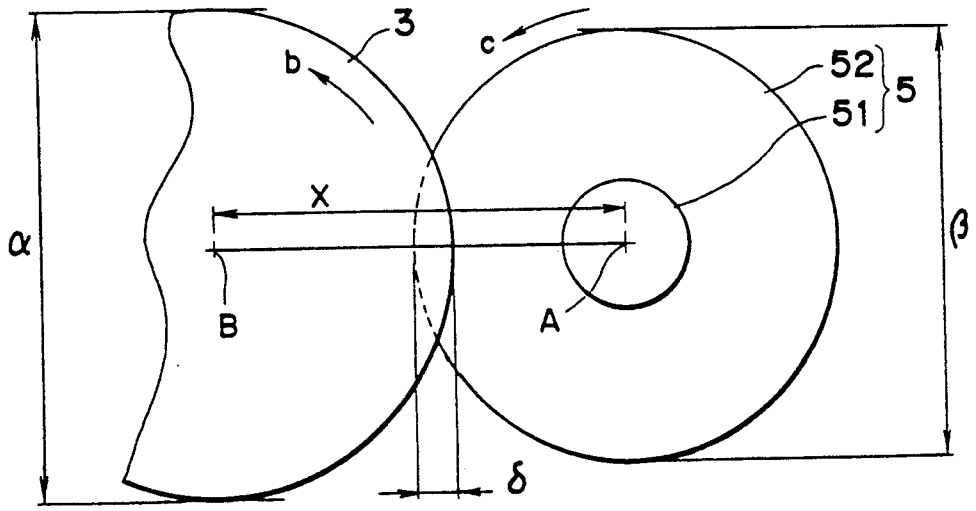
FIG. 2 is an explanation view for the variation of the resilient roller in a radial direction.

In this specification, the variation δ (mm) of the resilient roller in a radial direction thereof can be defined by the following expression (see FIG. 2):

$$\delta=(\tfrac{1}{2})\times(\alpha+\beta)-X$$

where α (mm) is a diameter of the developing sleeve, β (mm) is a diameter of the resilient roller, and X (mm) is a distance between an axis of the developing sleeve and that of the resilient roller.

Thus, it has been found that the rubber hardness the independently-porous cellular material is preferably 8° to 15° in Askar C hardness, and the variation δ in a radial direction is preferably 0.5 mm to 1.5 mm, the explanation of which follows.

A resilient roller 5 having an external diameter of 15 mm was fabricated in which a metallic core 61 having an external diameter of 5 mm was covered like a roller with a silicone rubber foam having a thickness of 5 mm, and a rubber hardness (Askar C) of 5°, 6°, 8°, 15°, 17° and 20°, and then built into a developing device having an aluminum sleeve having a diameter of 16 mm, whereby this developing device was installed in a copying machine FC-2 made by Canon, Inc. Other conditions were such that the surface potential of static latent image on the photosensitive body 1 was 600 V on the dark part and 150 V on the light part, the developing bias applied across the photosensitive body 1 and the developing sleeve 3 was a voltage in which a DC voltage of −250 V was superimposed on an AC voltage having a peak-to-peak voltage of 1200 V with a frequency of 1800 Hz, the peripheral speed of photosensitive body 1 was 50 mm/s while that of the developing sleeve 3 was 70 mm/s, and a gap between the sleeve 3 and the photosensitive body 1 was set at about 250 μm. The peripheral speed of the resilient roller 5 was set at 50 mm/s.

By varying the axis-to-axis distance X, the variation δ (mm) was variously changed to 0.2, 0.3, 0.5, 1.0, 1.5, 2.0 and 2.5 for each of the rubber hardnesses. When 2000 sheets of A4-size paper were printed, results were obtained as shown in Tables 1 and 2.

Table 1 shows the rubber hardness as the parameter, and Table 2 shows the variation δ in a radial direction as the parameter. Note that ○ means good, Δ possible and × impossible in Tables 1 and 2.

TABLE 1

| Rubber hardness for foam rubber (Asker C) | Image (for 2000 sheets) | |
|---|---|---|
| | Fog due to toner deterioration | Fog due to low molecular weight components of foam rubber adhering to sleeve |
| 5° | ○ | x |
| 6° | ○ | Δ |
| 8° | ○ | ○ |

TABLE 1-continued

| Rubber hardness for foam rubber (Asker C) | Image (for 2000 sheets) | |
|---|---|---|
| | Fog due to toner deterioration | Fog due to low molecular weight components of foam rubber adhering to sleeve |
| 15° | ○ | ○ |
| 17° | Δ | ○ |
| 20° | x | ○ |

TABLE 2

| Variation δ (mm) | Image (for 2000 sheets) | |
|---|---|---|
| | Blur | Fog |
| 0.2 | x | ○ |
| 0.3 | Δ | ○ |
| 0.5 | ○ | ○ |
| 1.0 | ○ | ○ |
| 1.5 | ○ | ○ |
| 2.0 | ○ | Δ |
| 2.5 | ○ | x |

As will be clearly seen from Table 1, if a cellular material having a rubber hardness of 5° (Askar C) is used, low molecular weight components of rubber adhere to the developing sleeve 3, incurring some fog, while if a cellular material having a rubber hardness of 20° (Asker C) is used, the contact pressure against the toner 6 is excessive, undesirably degrading the durability of the toner and incurring fog.

Accordingly, the usable range of rubber hardness for the independently-porous foam rubber forming the supply roller 5 is from 6° to 17° (Asker C), and the optimal range is from 8° to 15° (Asker C). Within this range, there is no attachment of low molecular weight components or rubber or occurrence of fog due to the deterioration of toner, whereby the supply of toner 6 onto the developing sleeve 3 and the peeling off of undeveloped toner 6 can be stably effected, so that it is possible to obtain an image faithful to a static latent image on the photosensitive body 1.

In Table 1, as the criterion as to whether the fog after the print of 2000 sheets is caused by the deterioration of toner 6 or the adherence of low molecular weight components onto the developing sleeve 3, the developing sleeve 3 is cleaned with MEK after 2000 sheets and then an image is developed, in which if there is still fog, deterioration of toner 6 is determined while if the fog disappears, adherence (contamination) of low molecular weight components of foam rubber onto the developing sleeve 3 is determined.

On the other hand, as will be clearly seen from Table 2, if the variation δ of the resilient roller 5 in a radial direction is set at 0.2 mm, the toner 6 may be unevenly applied onto or peeled off of the developing sleeve 3 by the resilient roller 5 in a longitudinal direction, so that blurs of the image undesirably occur. Conversely, if the variation δ is set at 2.5 mm, the toner may deteriorate or fuse to the developing sleeve 3, so that fog undesirably occurs. Accordingly, the proper range of variation δ in a radial direction for a resilient roller 5 constituted of an independently-porous cellular material is preferably from 0.3 mm to 2.0 mm, and more preferably from 0.5 mm to 1.5 mm.

In the above range, there occurs no blur due to uneven contact of the resilient roller 5 with the developing sleeve 3, or fog with deterioration of the toner due to excessive contact pressure against the developing sleeve 3, whereby the resilient roller 5 can stably supply the toner 6 on the developing sleeve 3 and peel off the undeveloped toner 6, so that an image faithful to the static latent image on the photosensitive drum 1 can be obtained.

Figure 3:
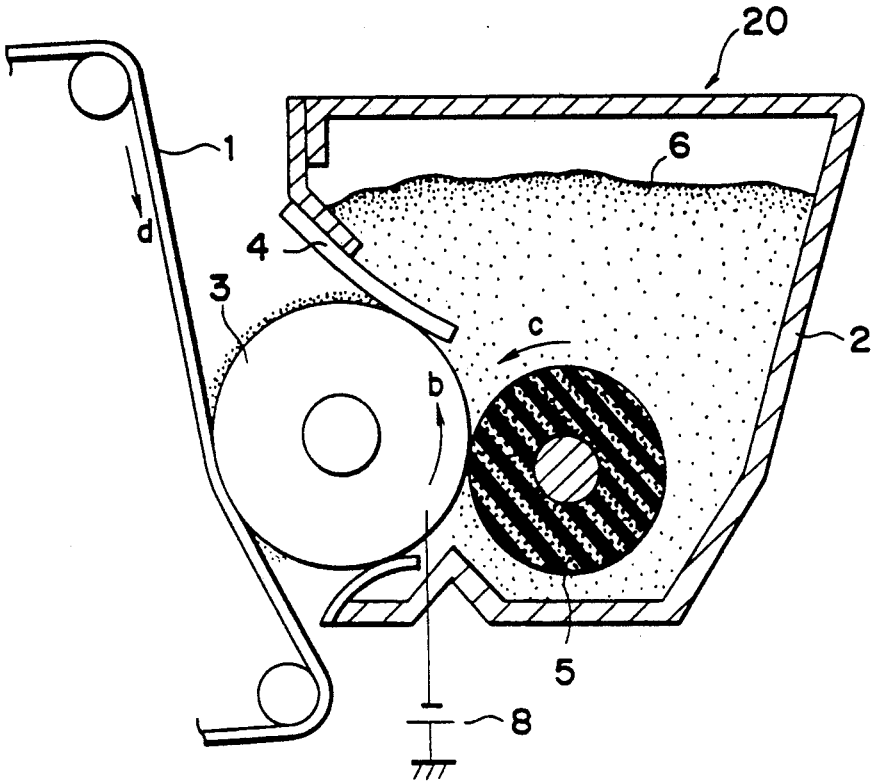
FIG. 3 is an explanation view of another embodiment of the present invention.

FIG. 3 shows a developing device according to another embodiment of the present invention. In this embodiment, a flexible belt photosensitive body is used as the photosensitive body 1, and the developing sleeve 3 is in contact with the belt photosensitive body 1. This belt photosensitive body 1 is one in which an OPC photosensitive layer for example is formed on the surface of a belt base layer such as polyethylene terephthalate (trade name "Mylar") having aluminum deposited on the surface layer, and moved in a direction of arrow d. In this embodiment, the peripheral speed of the belt photosensitive body 1 is about 50 mm/s, while the peripheral speed of the developing sleeve 3 is faster and about 100 mm/s, whereby a thin layer of toner on the developing sleeve 3 is rubbed with a relative speed with respect to the belt photosensitive body 1 to apply a triboelectricity to the toner 6 positively.

Note that the bias voltage applied to the developing sleeve 3 is only a DC (direct current) component, and the development is conducted with a voltage difference relative to the belt photosensitive body 1.

In this embodiment, if a foam rubber roller having a low hardness was used, low molecular weight components of rubber would adhere to the developing sleeve 3, and further would transfer to the photosensitive body 1, disordering a latent image on the photosensitive body 1, or contaminating a photosensitive layer on the photosensitive body 1, so that new adverse effects other than the fog, such as cracks, occurred.

In this embodiment, since the toner is subjected to a pressure at the nip between the photosensitive body 1 and the sleeve 3, it has been found that if the rubber hardness of the resilient roller 5 is high, and the variation δ is large, the deterioration of toner and the fusion onto the sleeve 3 are more likely to occur. However, with a rubber hardness of 8° to 15° in Askar C and a variation in a radial direction of 0.5 mm to 1.5 mm, there was no inconvenience as above described, whereby an excellent development image could be obtained.

Figure 4:
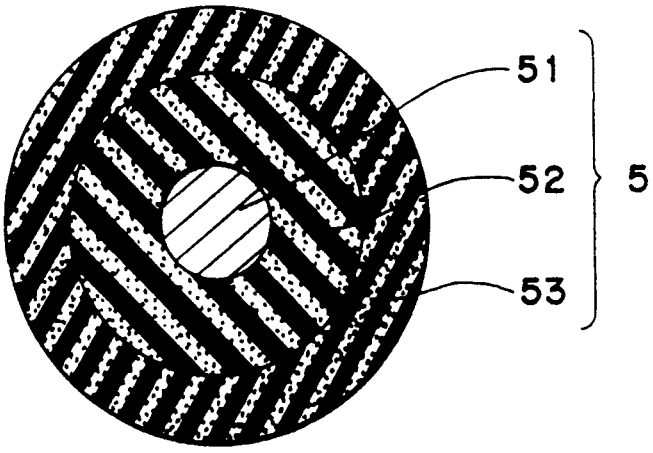
FIG. 4 is an explanation view of a resilient roller for use in a still further embodiment of the present invention.

In the next embodiment, the resilient roller of FIGS. 1 and 3 is constructed of a plurality of layers as shown in FIG. 4.

A resilient roller 5 is one in which a metallic core 51 is provided as the support shaft, which is then covered with a layer of a continuously-porous cellular material 52 having a low compression resilience and a low hardness such as polyurethane, and further covered with a layer of an independently-porous cellular material 53, with wall faces of bubble portions not communicating with adjacent bubble portions, such as silicone or CR rubber sponge, as shown in FIG. 4. In this way, since the independently-porous cellular material 53 is provided as the outermost layer of the resilient roller, and the continuously-porous cellular material having a lower compression resiliency and hardness than those of the cellular material 53 is provided inside thereof, the hardness of the whole resilient roller 5 decreases, whereby the resilient roller can be securely placed into contact with the developing sleeve 3 without excessive contact pressure with the developing sleeve 3. It is possible to reliably peel off undeveloped toner 6 on the developing sleeve 3 and supply new toner 6, with wall faces of bubbles on the surface of independently-porous cellular material 53 on the outermost layer. It is also possible to prevent clogging of toner 6 in the resilient roller 5 after a number of repetitive uses.

In this embodiment, the resilient roller 5 was constituted of a metallic core 51 having an outer diameter of 4 mm, around which polyurethane foam (trade name "Moltfilter", density of 0.030 g/cm$^3$) as the continuously-porous cellular material 52 was covered 3 mm thick like a roller, and further around which silicone foam (rubber hardness, Asker C 14°, density of 0.31 g/cm$^3$) as the independently-porous cellular material 53 was covered 2 mm thick like a roller, and had an outer diameter of 14 mm. This resilient roller 5 needed a contact width (nip) of about 1 to 10 mm with the developing sleeve 3, with the contact width being about 5 mm in this embodiment.

The relative speed between the resilient roller 5 and the developing sleeve 3 was preferably 20 to 200 mm/s, wherein in this embodiment the resilient roller was rotated at 50 mm/s in a direction of arrow c in this embodiment, and the peripheral speed of the developing sleeve 3 was 70 mm/s, so that the relative speed was made 120 mm/s.

A developing device of the present invention was incorporated in a copying machine FC-5 made by Canon, Inc., wherein the surface potential of a static latent image on the photosensitive body 1 was made 600 V in the dark part and 150 V in the light part, and the developing bias applied to the developing sleeve 3 was made a voltage in which a DC voltage of −250 V was superimposed on an AC voltage having a peak-to-peak voltage of 1200 V with a frequency of 1800 Hz. A copying operation of about 2000 sheets was performed, with the peripheral speed of photosensitive body 1 being 50 mm/s and the peripheral speed of developing sleeve 3 being 70 mm/s, so that there was no blur due to clogging of toner into the resilient roller 5 and no increase of the driving torque for the developing sleeve 3 and the resilient roller 5, even by the use of a toner of small grain diameter, and there occured no increase in fog due to material change of toner 6 (toner deterioration) as occurs when the contact pressure against the developing sleeve 3 with the toner 6 is too high, whereby an image faithful to the original without fog was obtained from the initial time to a latter half of durability.

In this embodiment, the independently-porous cellular material 52 is provided on the outer surface side of the resilient roller 5, but by using a cellular material having cells as fine as possible among continuously-porous cellular materials (the number of cells being 100 cells/inch or more, in contrast with 30 to 50 cells/inch in ordinary continuously-porous polyurethane foam), the effect of preventing toner grains from penetrating the resilient roller 5 can be greatly improved, whereby it is effectively used for the developing device to be changed after the copying of about 2000 sheets.

In another embodiment, the resilient roller 5 is constituted in such a manner that a metallic core 51 is provided as the support shaft, around which an independently-porous cellular material 52 having a low impact resilience and a low density is provided cylindrically, and further an independently-porous cellular material 53 having a slightly high impact resilience and a high density is provided cylindrically on the outermost layer.

In this embodiment, silicone foam having Asker C hardness of 5° was used for the independently-porous cellular material 52 having a low density, and silicone foam having a slightly higher density and Asker C hardness of 14° was used on the outer layer. With this constitution, the same effects as in the first embodiment could be obtained, and further the entry of toner 6 through both end portions of the resilient roller 5 in a longitudinal direction could be prevented.

In this embodiment, when the resilient roller 5 is constituted of only a silicone foam having a low impact resiliency and a low density around a metallic core, the contact pressure of the resilient roller 5 against the developing sleeve 3 can be further suppressed, but since a large amount of low molecular weight components are contained to obtain a foam having low impact resiliency and low density, fusion to the developing sleeve was undesirably caused due to exudation of low molecular weight components left over a long term. Since in this embodiment, a cellular material 53 with almost no exudation of low molecular weight components is provided around the outer peripheral surface of cellular material 52 having low impact resiliency containing such low molecular weight components, it is possible to prevent low molecular weight components from reaching the surface side of resilient roller 5 or the side of developing sleeve 3.

While a developing device using a one-component nonmagnetic developer was described above, it should be noted that the present invention also can be applied to a developing device using a one-component magnetic developer. In such a case, a magnet may be provided within the developing sleeve.

What is claimed is:

1. A developing device, comprising;

a vessel for containing one-component developer;

a rotatable developer bearing member for bearing one-component developer from said vessel to a developing portion for supplying the developer to an electrostatic latent image bearing member;

a regulating member for regulating a thickness of a layer of the one-component developer conveyed by said developer bearing member to said developing portion; and a rotatable resilient roller disposed within said vessel upstream of said regulating member with respect to a rotational direction of said developer bearing member and arranged to contact said developer bearing member, for supplying the developer to a surface of said developer bearing member proceeding toward the regulating member and the developing portion, and for removing the developer from the surface of said developer bearing member after the developer passes through said developing portion and returns into said vessel;

wherein said resilient roller is an independently-porous foam rubber roller having an Asker C hardness of 8° to 15° supported on a core member.

2. A developing device, comprising:

a vessel for containing one-component developer;

a rotatable developer bearing member for bearing the one-component developer from said vessel to a developing portion for supplying the developer to an electrostatic latent image bearing member;

a regulating member for regulating a thickness of a layer of the one-component developer conveyed by said developer bearing member to said developing portion; and a rotatable resilient roller disposed within said vessel upstream of said regulating member with respect to a rotational direction of said developer bearing member and arranged to contact said developer bearing member, for supplying the developer to a surface of said developer bearing member proceeding toward the regulating member and the developing portion, and for removing the developer from the surface of said developer bearing member after the developer passes through said developing portion and returns into said vessel;

wherein said resilient roller is an independently-porous foam rubber roller having an Asker C hardness of 82 to 15° supported on a core member, with a variation in a radial direction at a contact portion with said developer bearing member being 0.5 mm to 1.5 mm.

3. A developing device, comprising:

a vessel for containing one-component developer;

a rotatable developer bearing member for bearing the one-component developer from said vessel to a developing portion or supplying the developer to an electrostatic latent image bearing member;

a regulating member for regulating a thickness of a layer of the one-component developer conveyed by said developer bearing member to said developing portion; and a rotatable resilient roller disposed within said vessel upstream of said regulating member with respect to a rotational direction of said developer bearing member and arranged to contact said developer bearing member, for supplying the developer to a surface of said developer bearing member proceeding toward the regulating member and the developing portion, and for removing the developer from the surface of the developer bearing member after the developer passes through said developing portion and returns into said vessel;

wherein said resilient roller has an intermediate layer of a foam supported on a core member, and a surface layer covering said intermediate layer, with the compression resiliency of said intermediate layer being lower than that of said surface layer, wherein said intermediate layer is a continuously-porous foam rubber, and wherein said surface layer is an independently-porous foam rubber.

4. A developing device, comprising:

a vessel for containing one-component developer;

a rotatable developer bearing member for bearing the one-component developer from said vessel to a developing portion for supplying the developer to an electrostatic latent image bearing member;

a regulating member for regulating a thickness of a layer of the one-component developer conveyed by said developer bearing member to said developing portion; and a rotatable resilient roller disposed within said vessel upstream of said regulating member with respect to a rotational direction of said developer bearing member and arranged to contact said developer bearing member, for supplying the developer to a surface of said developer bearing member proceeding toward the regulating member and the developing portion, and for removing the developer from the surface of the developer bearing member after the developer passes through said developing portion and returns into said vessel;

wherein said resilient roller has an intermediate layer of a foam supported on a core member, and a surface layer covering said intermediate layer, with the compression resiliency of said intermediate layer being lower than that of said surface layer, and wherein said intermediate layer and surface layer are independently-porous foam rubber.

5. A developing device, comprising:

a vessel for containing one-component developer;

a rotatable developer bearing member for bearing the one-component developer from said vessel to a developing portion for supplying the developer to an electrostatic latent image bearing member;

a regulating member for regulating a thickness of a layer of the one-component developer conveyed by said developer bearing member to said developing portion; and a rotatable resilient roller disposed within said vessel upstream of said regulating member with respect to a rotational direction of said developer bearing member and arranged to contact said developer bearing member, for supplying the developer to a surface of said developer bearing member proceeding toward the regulating member and the developing portion, and for removing the developer from the surface of the developer bearing member after the developer passes through said developing portion and returns into said vessel;

wherein said resilient roller has an intermediate layer of a foam supported on a core member, and a surface layer covering said intermediate layer, with the compression resiliency of said intermediate layer being lower than that of said surface layer, and wherein said intermediate layer is a continuously-porous foam rubber, and said surface layer is a continuously-porous foam rubber having a higher cell density than that of said intermediate layer.

* * * * *

UNITED STATES PATENT AND TRADEMARK OFFICE

CERTIFICATE OF CORRECTION

PATENT NO. : 5,287,150

DATED : February 15, 1994

INVENTOR(S) : KINOSHITA, ET AL.

It is certified that error appears in the above-indentified patent and that said Letters Patent is hereby corrected as shown below:

IN THE ABSTRACT

Line 4, "a developing roller" should be deleted, and "with" (second occurrence) should read --with a developing roller--.

COLUMN 1

Line 21, "bearings" should read --bearing--.
Line 47, "other," should read --other),--.

COLUMN 2

Line 34, "constituion" should read --constitution--.

COLUMN 3

Line 46, "carried" should read --carried into--.

COLUMN 4:

Line 1, "presents" should read --prevents--.
Line 11, "pelled" should read --peeled--.

COLUMN 6:

Line 24, "hardness" should read --hardness of--.

Column 7

Line 47, "determined" should read --determined,--.

UNITED STATES PATENT AND TRADEMARK OFFICE

CERTIFICATE OF CORRECTION

PATENT NO. 5,287,150

DATED February 15, 1994

INVENTOR(S) KINOSHITA, ET AL.

It is certified that error appears in the above-indentified patent and that said Letters Patent is hereby corrected as shown below:

Column 8

Line 40, "Askar C" should read --Asker C--.

COLUMN 10

Line 31, "comprising;" should read --comprising:--.

COLUMN 11

Line 10, "82" should read --8°--.
Line 18, "or" should read --for--.

Signed and Sealed this

Thirtieth Day of August, 1994

Bruce Lehman

*Attest:*

BRUCE LEHMAN

*Attesting Officer*

*Commissioner of Patents and Trademarks*